US006820582B1

(12) United States Patent
Gabriel et al.

(10) Patent No.: US 6,820,582 B1
(45) Date of Patent: Nov. 23, 2004

(54) COOLING CHANNEL COVER FOR A ONE-PIECE PISTON OF AN INTERNAL COMBUSTION ENGINE

(75) Inventors: Dieter Gabriel, Highland, MI (US); Michael T. Lapp, Bloomsfield, MI (US)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/679,603

(22) Filed: Oct. 6, 2003

(51) Int. Cl.[7] ..... F02F 3/00
(52) U.S. Cl. ..... 123/193.6; 92/186
(58) Field of Search ..... 123/193.6, 41, 123/35; 92/186, 159, 190; 29/888.04, 888.045, 888.049

(56) References Cited

U.S. PATENT DOCUMENTS

| | | | | | |
|---|---|---|---|---|---|
| 4,986,167 | A | * | 1/1991 | Stratton et al. | 92/186 |
| 5,052,280 | A | * | 10/1991 | Kopf et al. | 92/186 |
| 5,144,923 | A | | 9/1992 | Leites et al. | |
| 5,261,363 | A | | 11/1993 | Kemnitz | |
| 5,357,920 | A | * | 10/1994 | Kemnitz et al. | 123/193.6 |
| 5,394,819 | A | | 3/1995 | Aarnio | |
| 5,546,896 | A | * | 8/1996 | Zaiser | 123/193.6 |
| 5,778,533 | A | | 7/1998 | Kemnitz | |
| 5,778,846 | A | * | 7/1998 | Mielke | 123/193.6 |
| 6,453,797 | B1 | * | 9/2002 | Bauer | 92/186 |
| 6,659,062 | B1 | * | 12/2003 | Issler | 123/193.6 |
| 6,722,263 | B2 | * | 4/2004 | Keller et al. | 92/186 |

FOREIGN PATENT DOCUMENTS

| | | |
|---|---|---|
| DE | 252 638 | 12/1987 |
| DE | 41 34 530 | 5/1992 |
| DE | 40 39 751 | 6/1992 |
| DE | 42 08 037 | 3/1998 |
| EP | 0 561 871 | 11/1995 |
| EP | 0 799 373 | 1/1999 |

OTHER PUBLICATIONS

International Standard ISO 1043–1 dated 1997.

* cited by examiner

*Primary Examiner*—Marguerite McMahon
(74) *Attorney, Agent, or Firm*—Collard & Roe, P.C.

(57) ABSTRACT

A cooling channel cover for a one-piece piston of an internal combustion engine, the piston having a closed cooling channel that runs around inside the piston crown and a ring-shaped recess between the piston ring band and the piston shaft. There is an easy to assemble cooling channel cover comprising a one-piece plastic/spring steel ring that is U-shaped in cross-section, having a ring bottom and an outer shank around the circumference, molded onto the ring bottom and angled off radially to the outside, and an inner shank around the circumference, angled off radially to the inside. There is a fist radial division having a mouth width (M) and a second radial division forming a first film hinge for radial deflection of one of the ring shanks and a second film hinge that permits at least one radial deflection of at least one of the radially angled shanks. In order to close off the cooling channel, the shanks engage in a stepped conical recess of on an inner circumferential edge of the cooling channel.

15 Claims, 2 Drawing Sheets

COOLING CHANNEL COVER FOR A ONE-PIECE PISTON OF AN INTERNAL COMBUSTION ENGINE

BACKGROUND OF THE INVENTION

1. Field of the Invention

The invention relates to a cooling channel cover for a one-piece piston of an internal combustion engine, the piston having a closed cooling channel that runs around inside the piston crown, at the level of the piston ring band, and a ring-shaped recess provided between the piston ring band and the piston shaft. The piston shaft is connected with the piston crown via hubs suspended on the piston crown.

2. The Prior Art

A multi-part cooled piston having a cooling channel arranged in the edge region of the piston head is described in German Publication No. DE 40 39 751 A1, which channel is covered with a sheet-metal ring essentially structured like a cup spring. This sheet-metal ring is structured in one piece and can be easily assembled with the piston only because the piston is structured in two parts. In this connection, it is necessary to assemble the sheet-metal ring with the upper piston part first, before the upper piston part is connected with the lower piston part.

Furthermore, pistons are described in German Publication No. DD 252 638 A1 and German Publication No. DE 41 34 530 A1, in which a wall part that covers the cooling channel that is open to the bottom, and runs around the circumference in ring shape, is structured as an open sheet-metal ring, which rests in a groove against the inside circumference of the piston ring zone, and against the outside circumference of the combustion chamber wall, respectively, taking advantage of its plastic deformation according to the Seeger ring principle, i.e. biased in the radial direction.

Furthermore, a multi-part piston having a cooling channel described in German Patent No. DE 42 08 037 C2, in which the cooling channel, which is open to the bottom, is covered by a biased cup spring, which is divided into at least two parts on its circumference, and rests freely on supports against axially opposite sides, radially on the inside and the outside.

Finally, one-piece cooling channel pistons having a cooling channel arranged in the edge region of the piston head are known from European Patents Nos. EP 0 561 871 B1 and EP 0 799 373 B1. In these patents, the channel is also closed off with cover rings structured like cup springs, or cover rings structured like cup springs and provided with a collar.

A disadvantage of the aforementioned embodiments is that the cover ring or cup spring must be structured in two parts, in order to be able to be assembled. Furthermore, during assembly, each of the two semi-circular ring halves must be individually introduced into corresponding bearings on the piston crown, in the biased state.

SUMMARY OF THE INVENTION

Proceeding from this, the invention is based on the task of creating a cooling channel cover for a one-piece piston of an internal combustion engine, which cover can be installed easily and quickly, and allowing for a reduction in piston weight as compared with the known state of the art.

This object is accomplished by means of a one-piece plastic or spring steel ring, U-shaped in cross-section, which has a ring bottom and an outer shank around the circumference, molded onto the ring bottom and angled off radially to the outside, and an inner shank around the circumference, angled off radially to the inside. A first film hinge radially deflects the ring shank of the ring formed by the hinge, in its positional plane. The ring has a first radial division having a mouth width and a second radial division, opposite the first division; on the circumference, which does not separate the radially angled outer shank that runs around the circumference, to form the first film hinge. In this manner, the cooling channel cover allows very simple and quick assembly on the piston, and the plastic/spring stell construction allows for a reduction in the piston weight. Furthermore, the plastic ring has a second film hinge, by means of which at least one radial deflection of at least one of the radially angled shanks is permitted, so that in order to close off the cooling channel, the shanks engage in a conical stepped recess on the inner circumference of the cooling channel.

The first film hinge is preferably determined by a material thickness of the outer shank. In a preferred embodiment, the second film hinge is formed on the outer shank or inner shank, and the film hinges are formed by a material weakening at an angle of the outer and inner shanks from the ring bottom.

The outer shank is angled off radially to the outside relative to a crosswise piston axis, and the inner shank is angled off radially to the inside, relative to the axis.

In a preferred embodiment, slits that extend close to the ring bottom are made in the outer and inner shanks, with the slits being non-uniformly distributed over the circumference of the ring, in order to produce different ridge lengths. The first film hinge is preferably arranged in a region between the slits. The slits preferably have a width of 2 to 3 mm and the ridge lengths between the slits are 15 to 20 mm.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
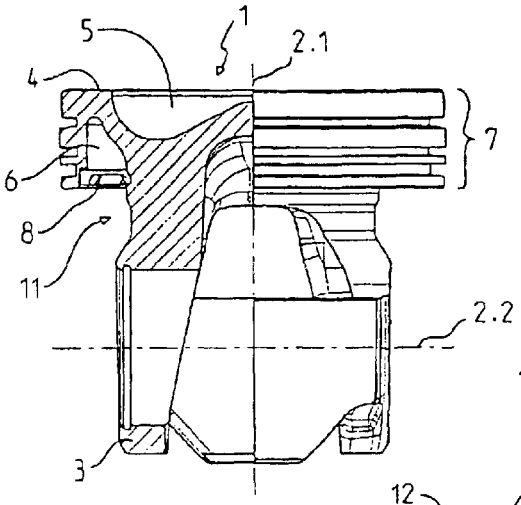
FIG. 1 shows a one-piece piston for an internal combustion engine, having a cooling channel, which channel is closed off by a U-shaped ring according to the invention, shown in a cross-sectional diagram that consists of two halves, which shows two longitudinal cross-sections of the piston, offset by 90°.
Figure 2:
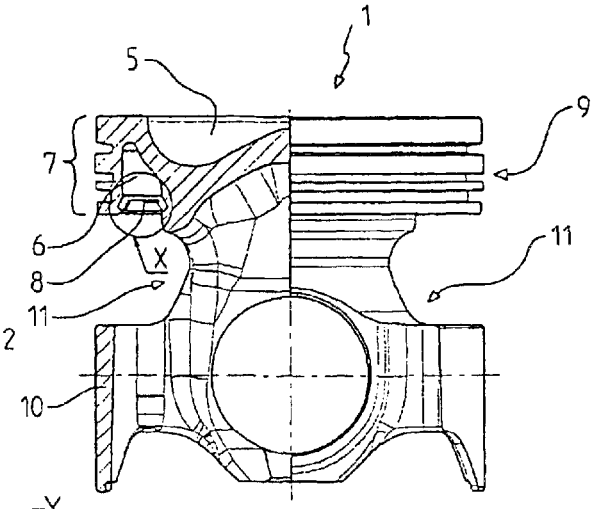
FIG. 2 shows a piston according to FIG. 1, rotated by 90°.

Referring now in detail to the drawings, FIG. 1 shows a piston 1, structured in one piece, for an internal combustion engine, in a cross-sectional diagram that consists of two halves, the left half representing a cross-section of piston 1 along a longitudinal axis 2 of the piston, and the right half representing a longitudinal axis of piston 1 that is offset from the former by 90°.

Piston 1 is made of steel and has a piston crown 9 having a piston ring band 7 and a piston head 4 having a combustion space depression 5. The piston shaft 10 is connected with piston hubs 3 suspended on piston crown 9. At the level of the piston ring band 7, a closed cooling channel 6 that runs around the circumference in ring shape is arranged in piston crown 9, the radial outer delimitation and radial inner delimitation of which channel are determined by the ring wall molded onto piston head 4 and by the piston crown region on which piston hubs 3 are suspended. The inside of cooling channel 6 has a recess 14.2 on the ring wall side and a recess 14.1 on the piston crown side, the wall regions of which result in a conically narrowed shape in the axial direction, towards piston head 4. The incline, in each instance, is characterized by the angle between the axial piston axis 2.1 and the slant of the recess wall, which is approximately 30°. Recesses 14.1 and 14.2 are delimited by a step 15.1 and 15.2, in each instance, which also result in a conically narrowed shape in the direction towards piston shaft 10, and whose aforementioned defined angle has a value of approximately 20 to 30°.

A ring-shaped recess 11 is provided between piston ring band 7 and piston shaft 10, by means of which assembly for closing off cooling channel 6 by means of a one-piece plastic/spring stell ring 8, U-shaped in cross-section, takes place.

According to the invention, an elastic plastic, particularly from the group of polyphenylene sulfides (abbreviation: PPS), for example Ryton R4®, is used for this purpose. In a further embodiment of the invention, a plastic from the group of high-temperature polyimides (abbreviation: PI), such as VESPEL® from DuPont or AURM® from Mitsui Chemicals Inc., for example, can also be used for this purpose. Such plastics are characterized by their resistance to high temperatures, i.e. heat, of 200° C. to over 400° C. in long-term operation. In addition, the plastic can also be fiber-reinforced. The abbreviations correspond to the international standard ISO 1043-1 dated 1997. The spring stell can be used a stol carbon stell material like a 75. Temperature can be optional.

Figure 4:
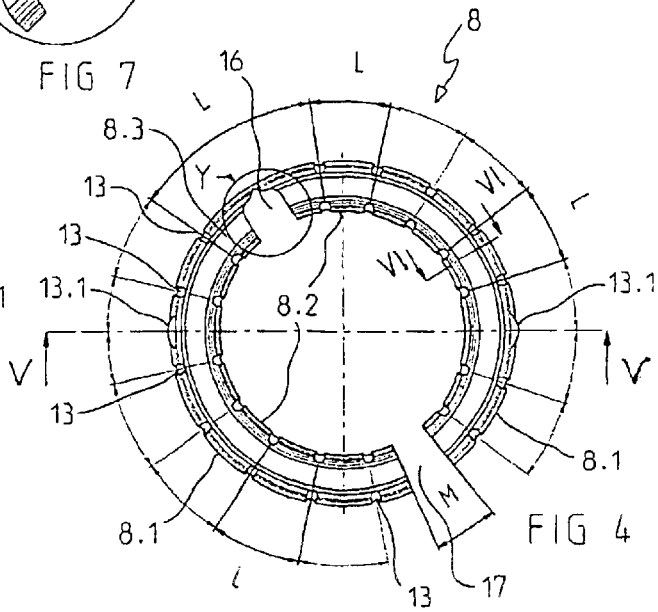
FIG. 4 shows a top view of the U-shaped ring.

According to FIG. 4, U-shaped plastic ring 8 has a radial outer shank 8.1 angled away from its ring bottom 8.3, and a radial inner shank 8.2 angled away, which are divided by slits 13 non-uniformly distributed over the circumference, so that shank segments L of different lengths are formed. The slits are made down close to the bottom 8.3 of the plastic ring 8 and have a slightly V-shaped form and a slit width of 2 to 3 mm. The aforementioned radial slitting takes place distributed over the circumference of the ring, preferably in an angle range between 15 and 25°.

Figure 6:
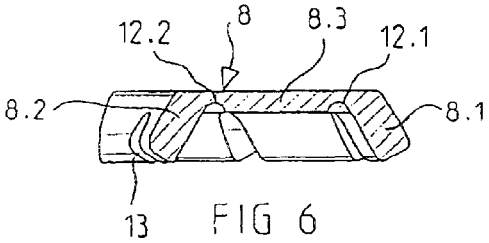
FIG. 6 shows a cross-section along the line VI—VI of the U-shaped ring according to FIG. 4.
Figure 5:
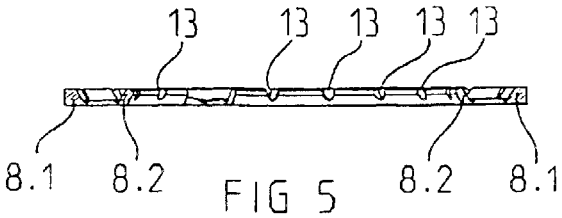
FIG. 5 shows a cross-section along the line V—V of the U-shaped ring according to FIG. 4.

As shown in the cross-sectional diagram according to FIG. 6, outer shank 8.1 is arranged on the outside circumference of ring bottom 8.3, and angled off radially to the outside with reference to the crosswise axis 2.2 of the piston, from ring bottom 8.3. Inner shank 8.2 is angled off radially towards the inside, and is arranged on the inside circumference of piston bottom 8.3. On the inside angles of shanks 14.1 and 14.2 from ring bottom 8.3, so-called second film hinges 12.1 and 12.2 are arranged around the circumference, which are formed by a material weakening that goes around the circumference of the plastic ring 8. In accordance with another exemplary embodiment of the invention, such a film hinge can also be arranged only on the radially outer shank 8.1 or the radially inner shank 8.2 of U-shaped plastic ring 8.

As is evident from FIG. 4, U-shaped plastic ring 8 is radially divided so that an opening 17 with a mouth width M is formed. At 180° opposite to this, there is a U-shaped opening 16 having approximately the same width. Both openings 16 and 17 serve as the oil inlet and oil outlet, respectively, in the assembled state of ring 8, to supply cooling channel 6 with oil.

Figure 7:
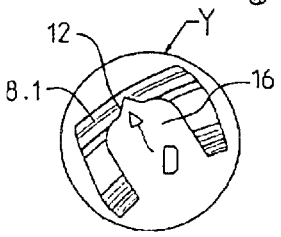
FIG. 7 shows a partial detail of the piston according to Detail Y from FIG. 4.
Figure 3:
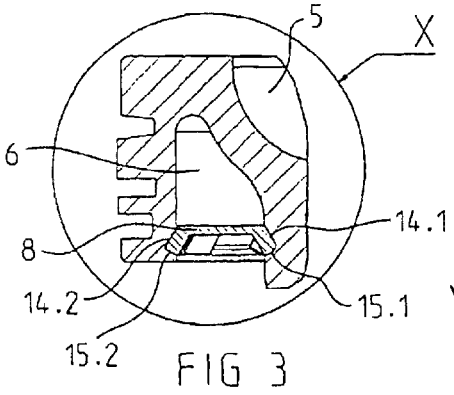
FIG. 3 shows a partial detail of the piston according to Detail A from FIG. 1.
Figure 8:
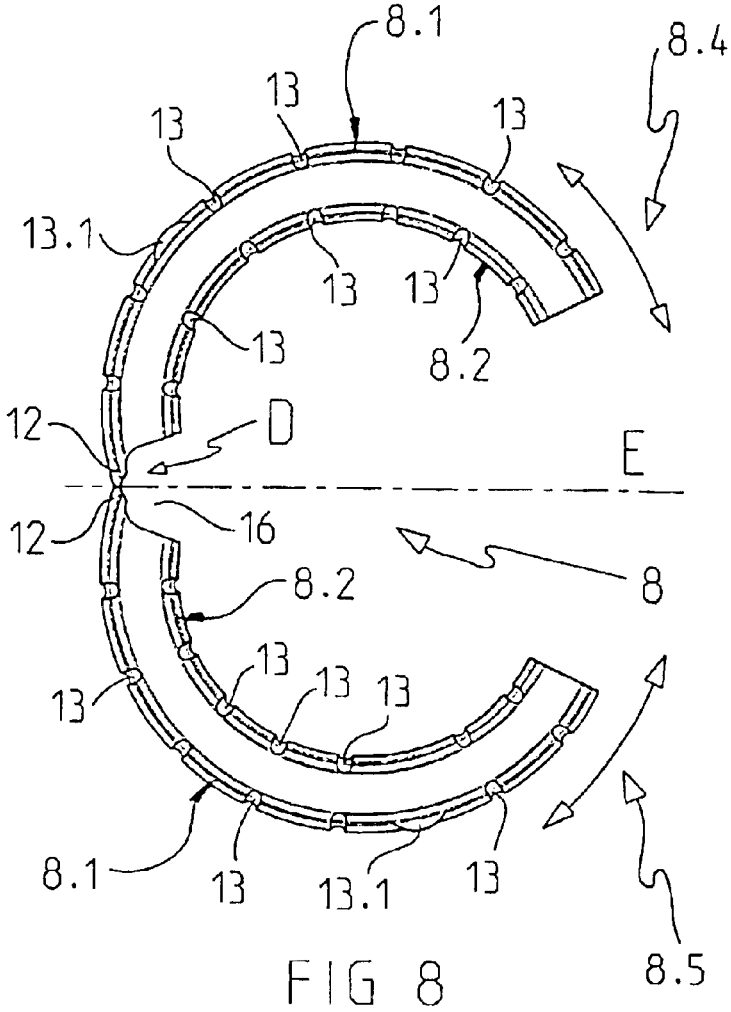
FIG. 8 shows a top view of the U-shaped ring, in the state in which it is opened by the film hinge according to the invention.

According to FIG. 4, i.e. according to the enlarged detail view according to FIG. 7, a so-called first film hinge 12 is arranged on the radially outer and center end of opening 16, which hinge is essentially formed by a second radial cut D into piston head 4 up to outer shank 8.1, so that radial deflection of ring shanks 8.4 and 8.5 resulting from the film hinge, in the positional plane E of the plastic ring, as shown by arrows in FIG. 8, is made possible by way of the material thickness of the outer shank 8.1. In this connection, the size of the deflection of the ring shanks is determined by the mechanical strength of the plastic used for ring 8, and can certainly take place all the way to contact of the outside radii of the ring.

Figure 9:
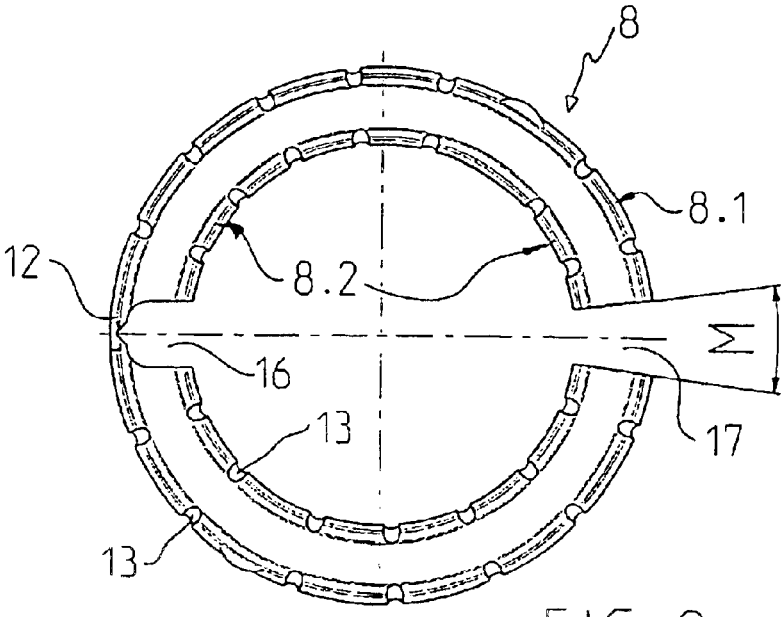
FIG. 9 shows a top view of the U-shaped ring, in the state in which it is closed by the film hinge according to the invention.

In accordance with another exemplary embodiment of the invention, not shown, such a film hinge 12 can also be arranged on radially inner shank 8.1 of U-shaped ring 8, whereby in this embodiment, opening 16 is directed not radially inward, as shown in FIGS. 8 and 9, but rather radially outward. However, this greatly limits the deflection of the two ring shanks 8.4 and 8.5, since this is determined by the width of the opening 16.

Assembly of ring 8 can take place in a simple manner, in that it is bent up, using first film hinge 12, in such a way that it is introduced into recess 11, and pushed over the hub region suspended on piston crown 9. In this pre-assembled state, the ring is oriented towards piston head 4 with its ring bottom 8.3. In order to close off cooling channel 6, ring 8 is subsequently pressed over steps 15.1 and 15.2, so that its outer and inner shanks 8.1 and 8.2 come to rest on recesses 14.1 and 14.2. The faces of the shanks are supported on the steps. The radial deflection of shanks 8.1 and 8.2 is guaranteed by the second film hinges 12.1 and 12.2 of the plastic ring. One or two projections 13.1 that are arranged, for example, on the circumference, projecting on the circumference, opposite the outer shank 8.1, and engage in one or two recesses in the cooling channel, not shown, prevent the U-shaped ring from rotating out of place.

Accordingly, while only a few embodiments of the present invention have been shown and described, it is obvious that many changes and modifications may be made thereunto without departing from the spirit and scope of the invention.

Reference Symbol List

1 piston
2.1 longitudinal piston axis
2.2 crosswise piston axis
3 piston hubs
4 piston head
5 combustion space depression
6 cooling channel

7 piston ring band
8 U-shaped ring
8.1 radially outer shank
8.2 radially inner shank
8.3 ring bottom
9 piston crown
10 shaft
11 ring-shaped recess
12 film hinge
12.1 film hinge of the radially outer shank
12.2 film hinge of the radially inner shank
13 slits
13.1 projections
14.1/14.2 circumferential recess
15.1/15.2 steps
16 cooling oil inlet
17 cooling oil outlet
D second radial division
E positional plane
L ridge length
M mouth width

What is claimed is:

1. A cooling channel cover for a one-piece piston of an internal combustion engine, the piston having a closed cooling channel that runs around inside a piston crown, at a level of a piston ring band, and a ring-shaped recess provided between the piston ring band and a piston shaft, the piston shaft being connected with the piston crown via hubs suspended on the piston crown, the cover comprising a one-piece plastic/spring steel ring having the following characteristics:

a U-shaped cross-section;

a ring bottom;

an outer shank around a circumference of the ring, molded onto the ring bottom and angled off radially to the outside;

an inner shank around the circumference of the ring, angled off radially to the inside;

a first radial division on the ring, said division having a mouth width;

a second radial division on the circumference of the ring, opposite the first division, wherein said second radial division does not separate the outer shank, said second radial division forming a first film hinge for radial deflection of one of the shanks, in its positional plane; and a second film hinge that permits at least one radial deflection of at least one of the shanks, in such a manner that in order to close off the cooling channel, the shanks are adapted to engage in a stepped conical recess on an inner circumferential edge of the cooling channel.

2. The cooling channel cover according to claim 1, wherein the first film hinge is determined by a material thickness of the outer shank.

3. The cooling channel cover according to claim 1, wherein the second film hinge is formed on the outer shank or inner shank, and wherein the film hinges are formed by a material weakening at an angle of the outer and inner shanks from the ring bottom.

4. The cooling channel cover according to claim 1, wherein slits that extend close to the ring bottom are made in the outer and inner shanks, said slits being non-uniformly distributed over the circumference of the ring, in order to produce different ridge lengths.

5. The cooling channel cover according to claim 4, wherein the first film hinge is arranged in a region between the slits.

6. The cooling channel cover according to claim 5, wherein the slits have a width of 2 to 3 mm and the ridge lengths between the slits are 15 to 20 mm.

7. The cooling channel cover according to claim 1, wherein the U-shaped ring is made of a polyphenylene sulfide (PPS) or a polyimide (PI) or a carbon spring steel.

8. A one-piece piston of an internal combustion engine, comprising:

a piston crown a closed cooling channel that runs around inside the piston crown at a level of a piston ring band;

a piston shaft connected with the piston crown via hubs suspended from the piston crown;

a ring-shaped recess provided between the piston ring band and the piston shaft; and a cooling channel cover comprising a one-piece plastic/spring steel ring having the following characteristics:

a U-shaped cross-section;

a ring bottom;

an outer shank around a circumference of the ring, molded onto the ring bottom and angled off radially to the outside;

an inner shank around the circumference of the ring, angled off radially to the inside;

a first radial division on the ring, said division having a mouth width;

a second radial division on the circumference of the ring, opposite the first division, wherein said second radial division does not separate the outer shank, said second radial division forming a first film hinge for radial deflection of one of the shanks, in its positional plane; and a second film hinge that permits at least one radial deflection of at least one of the shanks, in such a manner that in order to close off the cooling channel, the shanks engage in a stepped conical recess on an inner circumferential edge of the cooling channel.

9. The piston according to claim 8, wherein the first film hinge is determined by a material thickness of the outer shank.

10. The piston according to claim 8, wherein the second film hinge is formed on the outer shank or inner shank, and wherein the film hinges are formed by a material weakening at an angle of the outer and inner shanks from the ring bottom.

11. The piston according to claim 8, wherein the outer shank is angled off radially to the outside relative to a crosswise piston axis, and the inner shank is angled off radially to the inside, relative to said axis.

12. The cooling channel cover according to claim 8, wherein slits extend to the ring bottom are made in the outer and inner shanks, said slits being non-uniformly distributed over the circumference of the ring, in order to produce different ridge lengths.

13. The cooling channel cover according to claim 12, wherein the first film hinge is arranged in a region between the slits.

14. The cooling channel cover according to claim 12, wherein the slits have a width of 2 to 3 mm and the ridge lengths between the slits are 15 to 20 mm.

15. The cooling channel cover according to claim 8, wherein the U-shaped ring is made of a polyphenylene sulfide (PPS) or a polymide (PI) or carbon spring steel.

* * * * *